US005111997A

United States Patent [19]

Ikuta et al.

[11] Patent Number: 5,111,997

[45] Date of Patent: May 12, 1992

[54] AUTOMATIC SPRAY PAINTING MACHINE

[75] Inventors: Shizuo Ikuta, Sagamihara; Masaharu Okuda; Takashi Sakamoto, both of Yokohama, all of Japan

[73] Assignee: Taikisha, Ltd., Tokyo, Japan

[21] Appl. No.: 615,229

[22] Filed: Nov. 19, 1990

[30] Foreign Application Priority Data

Nov. 21, 1989 [JP] Japan ..... 1-304202

[51] Int. Cl.[5] ..... B05B 3/00; B05B 3/18

[52] U.S. Cl. ..... 239/750; 239/227

[58] Field of Search ..... 239/750–754, 239/227, 264; 118/323, 697, 698

[56] References Cited

U.S. PATENT DOCUMENTS

| | | | |
|---|---|---|---|
| 4,564,410 | 1/1986 | Clitheros et al. | 118/323 |
| 4,616,782 | 10/1986 | Marietta et al. | 118/323 |
| 4,656,049 | 4/1987 | Noto | 118/323 |
| 4,865,887 | 9/1989 | Virtanen | 118/323 |
| 4,905,913 | 3/1990 | Frikker | 239/751 |
| 4,931,322 | 6/1990 | Yamamoto et al. | 118/323 |
| 4,951,600 | 8/1990 | Soshi et al. | 118/323 |
| 4,977,000 | 12/1990 | Murayama et al. | 118/323 |

FOREIGN PATENT DOCUMENTS 201667 12/1988 Japan .

*Primary Examiner*—Andres Kashnikow
*Assistant Examiner*—Lesley D. Morris
*Attorney, Agent, or Firm*—Webb, Burden, Ziesenheim & Webb

[57] ABSTRACT

The present invention relates to an automatic spray painting machine comprising a first movable portion movable in a direction toward and away from a work object, a second movable portion movable in a specified direction perpendicular to the moving direction of the first movable portion, a supporting portion for supporting a spray nozzle, a first actuator for moving the first movable portion, and a second actuator for moving the second movable portion. The first and second actuators are mounted on the supporting portion. The automatic spray painting machine further includes a transmission mechanism for transmitting drive of the actuator to the movable portion positioned closer to the spray nozzle in the supporting order effects drive transmission, with the other movable portion positioned closer to the supporting portion in the supporting order being allowed to move.

7 Claims, 5 Drawing Sheets

AUTOMATIC SPRAY PAINTING MACHINE

BACKGROUND OF THE INVENTION

1. Field of the Invention

The present invention relates to an automatic spray painting machine comprising a first movable portion movable in a direction toward and away from a work object, a second movable portion movable in a specified direction perpendicular to the moving direction of the first movable portion, and a spray nozzle supported by a supporting portion through the first and second movable portions.

2. Description of the Prior Art

In the conventional automatic spray painting machines of the above noted type, an actuator for one of the first and second movable portions which is positioned closer to the supporting portion in the supporting order is mounted on the supporting portion, while an actuator for the other movable portion which is positioned closer to the spray nozzle in the supporting order is mounted on the aforementioned movable portion mounted on the supporting portion.

In order to oscillate the spray nozzle in the moving direction of the second movable portion for varying its direction, a third actuator for oscillating the spray nozzle is mounted on the movable portion of the two movable portions which is positioned closer to the spray nozzle in the supporting order. (see Japanese Utility Model Application "Kokai" No. 63-201667.)

Each movable portion in the conventional machines is moved in considerably high speed, e.g. 10–80 m/min. However, the actuators are mounted on these movable portions movable in high speed, which results in heavy weight of the movable portions to excessively increase inertia in movement of the movable portions. Thus, large clatters occur when the movable portions move in reverse directions. This causes an uneven painted condition and deterioration of the durability of the machine. In addition, rigid and reinforced components are required for the actuators and devices in the movable portions carrying the actuators, which results in high manufacturing cost of the whole machine.

An object of the present invention is to provide an improved automatic spray painting machine which solves the above noted problems of the conventional art.

SUMMARY OF THE INVENTION

In order to achieve the above object, an automatic spray painting machine according to the present invention comprises a first movable portion movable in a direction toward and away from a work object, a second movable portion movable in a specified direction perpendicular to the moving direction of the first movable portion, a spray nozzle supported by a supporting portion through the first and second movable portions, a first actuator for moving the first movable portion and a second actuator for moving the second movable portion mounted on the supporting portions, respectively, wherein a transmission mechanism transmits drive of the actuator to one of the movable portions positioned closer to the spray nozzle in the supporting order, with the other of the movable portions positioned closer to the supporting portion in the supporting order being allowed to move.

With this arrangement, since both of the first and second actuators for the first and second movable portions are mounted on the supporting portion, the movable portions are lightened to decrease inertia in movement of the movable portions, compared with the conventional machines having the actuators mounted on the movable portions.

Also, since the transmission mechanism for one of the first and second movable portions which is positioned closer to the spray nozzle in the supporting order transmits drive of the actuator mounted on the supporting portion to the aforementioned movable portions, no problem occurs in movement of the other of the movable portions which is positioned closer to the supporting portion in the supporting order, though both of the actuators for the first and second movable portions are mounted on the supporting portion.

As described above, inertia in movement of the movable portions can be diminished, compared with the conventional machines, which can restrain clatters in reverse movement of the movable portions and prevent effectively the resulting uneven painted condition and deterioration of the durability of the machine. Additionally, the compact structures of various components for the actuators and devices for the movable portions can reduce the manufacturing cost of the machine.

It is further preferable that the spray nozzle is directionally variable by oscillation in the moving direction of the second movable portion, the supporting portion carries a third actuator for oscillating the spray nozzle, and that a transmission mechanism for varying the nozzle direction and transmitting drive of the third actuator to the spray nozzle effects drive transmission with the first and second movable portions being allowed to move.

With this structure, in the machine having the directionally variable spray nozzle oscillatable in the moving direction of the second movable portion, the third actuator is mounted on the supporting portion together with the first and second actuators. As a result, the weight of the movable portions can be further reduced to realize further decreased inertia in movement of the movable portions, compared with the conventional machines having the third actuator mounted on the movable portion.

Since the transmission mechanism for varying the nozzle direction transmits drive of the third actuator to the spray nozzle with the first and second movable portions being allowed to move, no problem occurs in movement of the first and second movable portions positioned between the supporting portion and the spray nozzle, though the third actuator is mounted on the supporting portion.

Thus, in the machine having the directionally variable spray nozzle oscillatable in the moving direction of the second movable portion, inertia in movement of the movable portions can be further reduced, which can prevent more effectively the uneven painted condition caused by the clatters of the movable portions and deterioration of the durability of the machine. It is also advantageous in that the manufacturing cost can be further reduced owing to the compact components for the actuators and devices.

Other objects, structures and advantages will be apparent from the following description with reference to the accompanying drawings.

BRIEF DESCRIPTION OF THE DRAWINGS

The drawings show an automatic spray painting machine embodying the present invention in which.

DETAILED DESCRIPTION OF THE PREFERRED EMBODIMENTS

With reference to the accompanying drawings, preferred embodiments according to the present invention will be described below.

Figure 1:
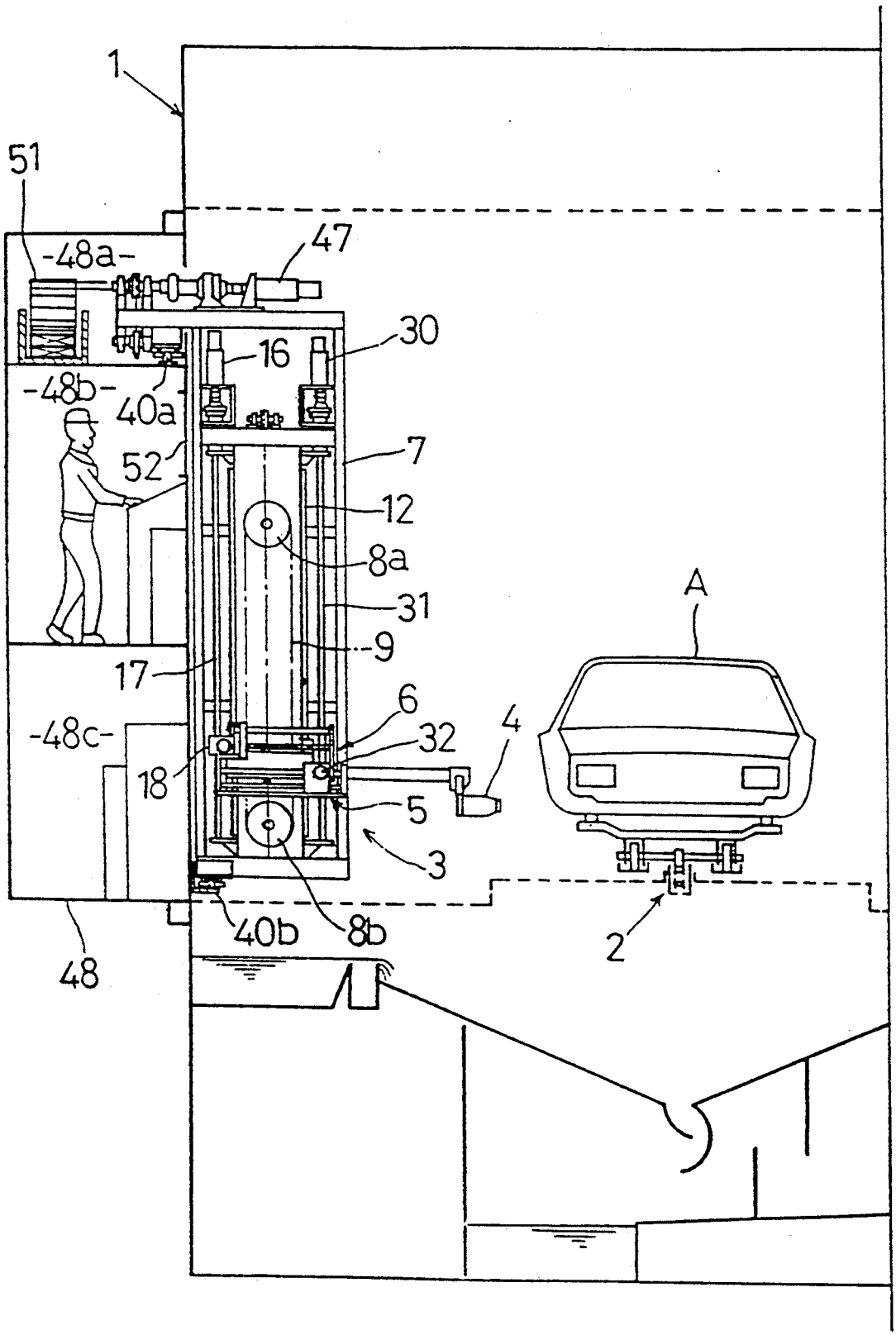
FIG. 1 is a sectional view of a spray painting booth.

In FIG. 1, numeral 1 denotes a painting booth, numeral 2 denotes a conveyer device for conveying an automobile body (A) to be painted as a work object inside the booth, and numeral 3 denotes a side automatic painting device for spraying paint on a side surface of the automobile body A.

Figure 2:
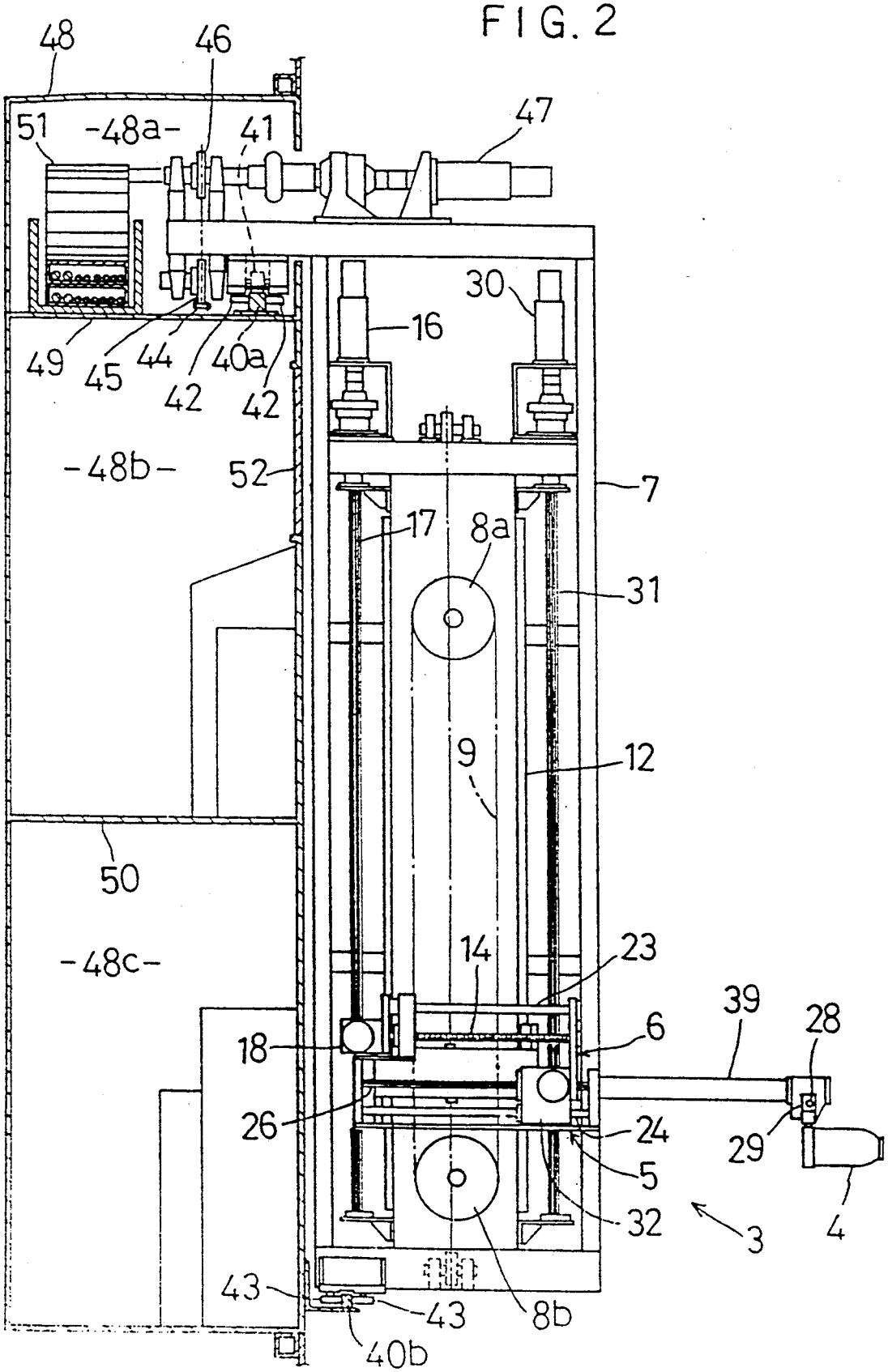
FIG. 2 is a side view of the machine.
Figure 3:
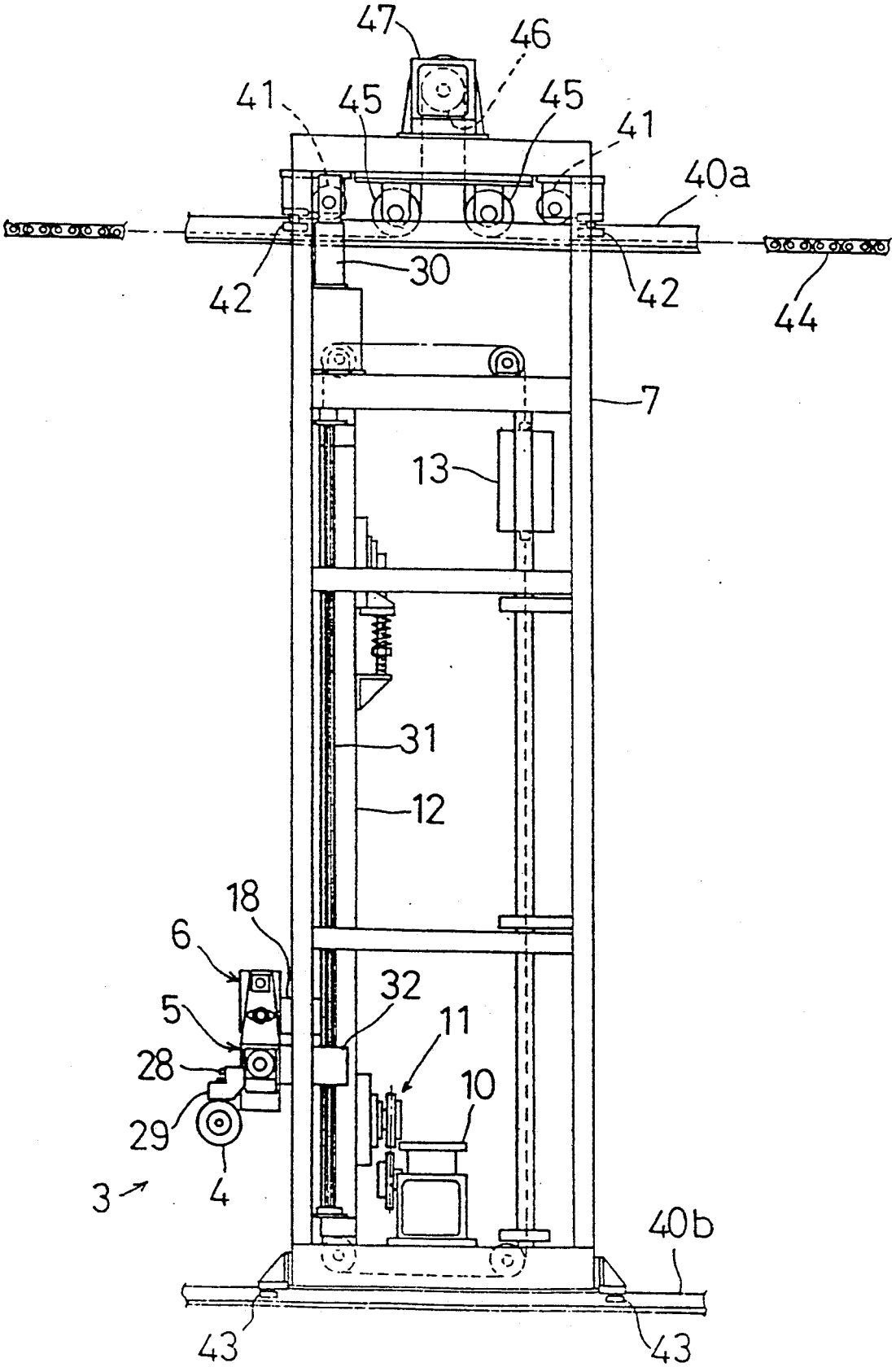
FIG. 3 is a front view of the machine.
Figure 4:
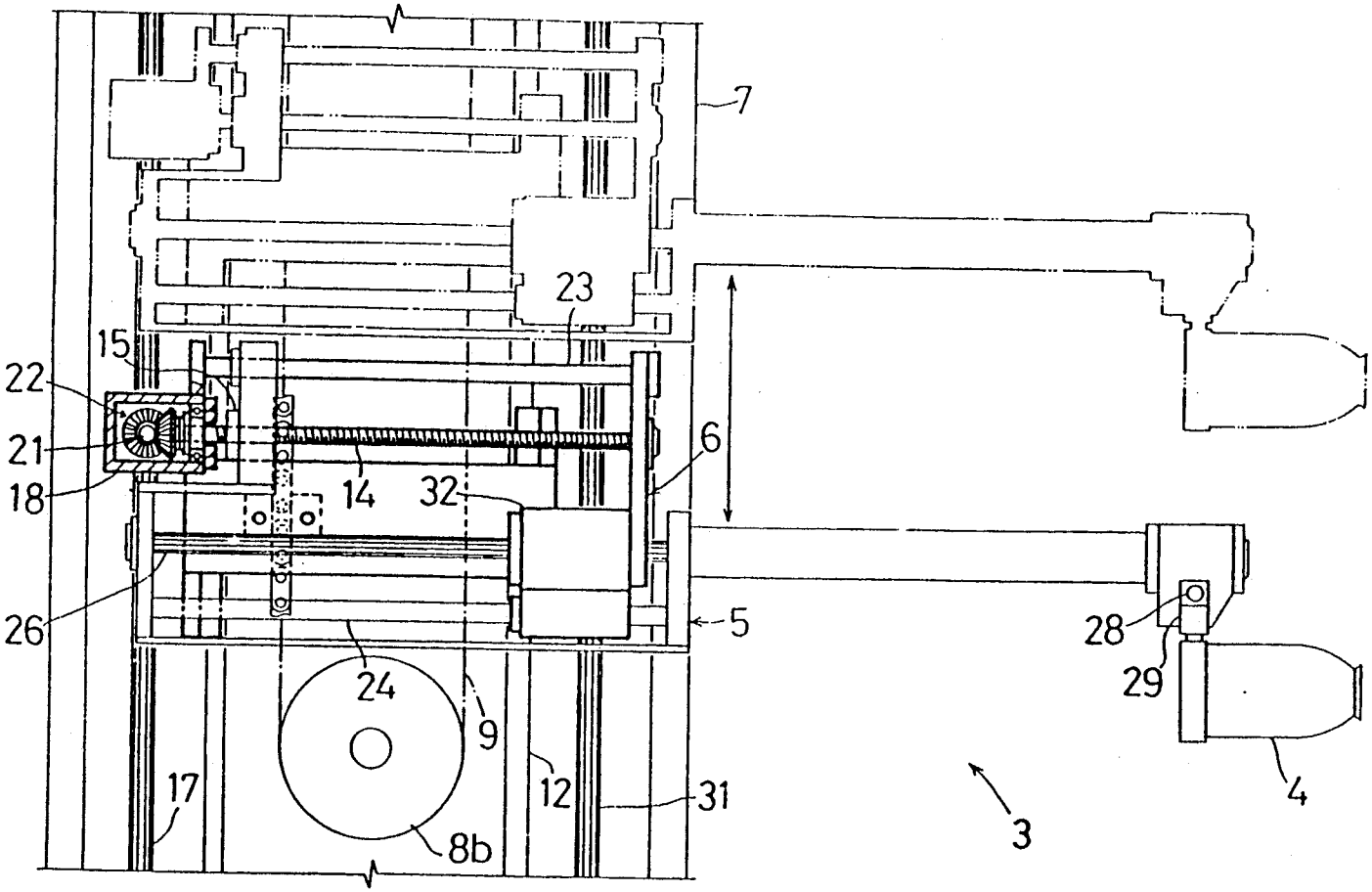
FIGS. 4(*a*) and 4(*b*) are enlarged side view of the machine.
Figure 4:
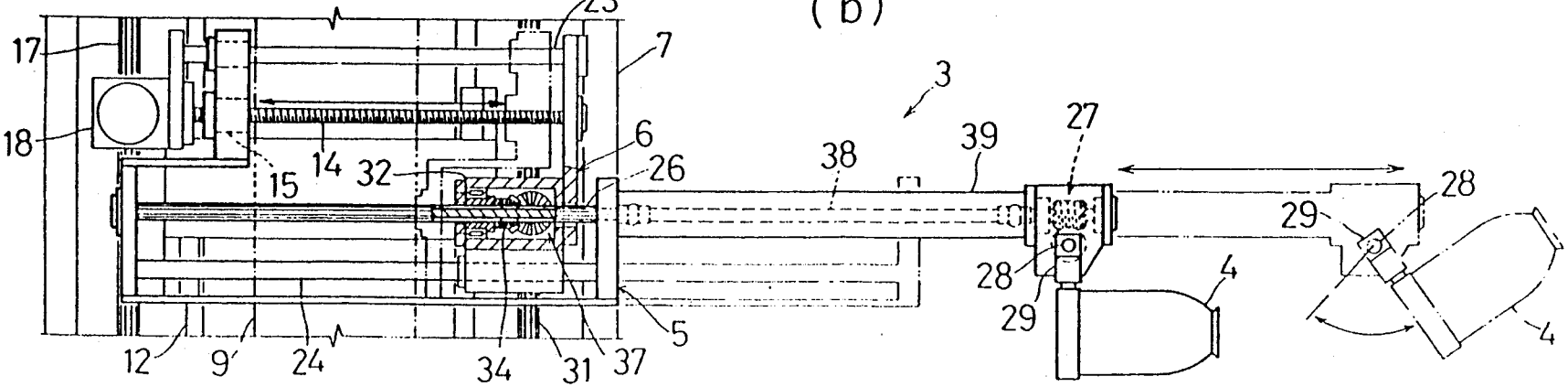

As shown in FIGS. 2 and 4, the side automatic painting device 3 basically comprises a horizontal movable unit 5 (shown in a bold line in FIG. 4(*b*)) acting as a first movable portion having a spray nozzle 4 supportedly connected thereto, a lift unit 6 (shown in a bold line in FIG. 4(*a*)) acting as a second movable portion, and a base unit 7. The horizontal movable unit 5 is connectably supported by the lift unit 6 to be movable in a direction toward and away from the automobile body A. The lift unit 6 is connectably supported by the base unit 7 to be vertically movable, i.e. to be movable in a specified direction perpendicular to the moving direction of the horizontal movable unit 5. Thus, the spray nozzle 4 is supported by the base unit 7 acting as a supporting portion through the serially arranged horizontal movable unit 5 and the lift unit 6.

The spray nozzle 4 is further connectably supported by the horizontal movable unit 5 to be vertically oscillatable for varying its direction, i.e. to be oscillatable in the moving direction of the lift unit 6.

With the above noted structure, the horizontal movable unit 5 is moved to maintain a constant distance between the spray nozzle 4 and the side surface of the automobile body A, the spray nozzle 4 is oscillatable to constantly normal to and oppose to the side surface of the automobile body A, and the lift unit 6 is vertically reciprocated, whereby the curved side surface of the automobile body A is appropriately painted.

The base unit 7 is connectably supported by a side wall of the painting booth 1 to be movable in the conveying direction of the automobile body A. By moving the base unit 7, a position of the side automatic painting device 3 is suitably variable in the conveying direction of the automobile body A with a variety of working conditions in a spray painting operation.

The lift unit 6 has a driving structure including sprockets 8*a* and 8*b* mounted an upper portion and a lower portion of the base unit 7, and a chain 9 extending between and wounded around the sprockets 8*a* and 8*b*. The lift unit 6 is connected to a portion of the chain 9. The lower sprocket 8*b* is rotated by a lift unit driving motor 10 acting as a first actuator through a chain transmission mechanism 11, and is repeatedly rotated in a reverse direction, thereby to vertically reciprocate the lift unit 6.

Numeral 12 denotes a lifting guide mounted on the base unit 7 for guiding the vertical movement of the lift unit 6. Numeral 13 denotes a balance weight for compensating the self-weight of the lift unit 6.

The horizontal movable unit 5 has a driving structure including a screw shaft 14 mounted on the lift unit 6, and a ball screwed portion 15 fitted on the screw shaft 14, the ball screw portion and the screw shaft being mounted on the horizontal movable unit 5.

A horizontal movable unit driving motor 16 acting as a second actuator is mounted above the base unit 7. A vertical first spline shaft 17 rotated by the motor 16 is mounted on the base unit 7 extending through a first gearbox 18 provided in the lift unit 6.

Figure 5:
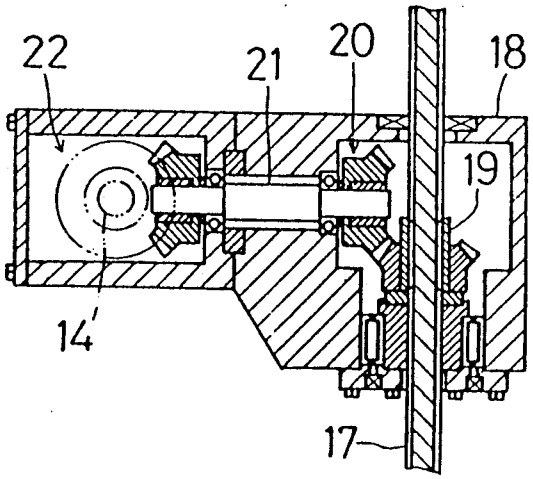

As seen from FIG. 5, a first ball spline 19 is mounted on the first gearbox 18 for slidably fitting on the first spline shaft 17 to receive rotation of the first spline shaft 17. Rotation of the first ball spline 19 is transmitted to the screw shaft 14 through a first bevel gear mechanism 20, a relay shaft 21 and a second bevel gear mechanism 22.

More particularly, the lift unit 6 of the two movable units which is positioned closer to the base unit 7 in the supporting order is adapted to be vertically movable by sliding movement of the first ball spline 19 relative to the first spline shaft 17. In this condition, a transmission mechanism for transmitting drive of the horizontal movable unit driving motor 16 mounted on the base unit 7 to the horizontal movable unit 5 positioned closer to the spray nozzle 4 in the supporting order includes the first spline shaft 17, the first ball spline 19, the first bevel gear mechanism 20, the relay shaft 21, the second bevel gear mechanism 22, the screw shaft 14 and the ball screwed portion 15. The screw shaft 14 mounted on the lift unit 6 is rotated by the horizontal movable unit driving motor 16 mounted on the base unit 7, whereby the horizontal unit 5 is movable in the direction toward and away from the automobile body A by screw engagement between the screw shaft 14 and the ball screwed portion 15.

Numerals 23 and 24 denote a lift unit guide rod and a horizontal movable unit guide rod for guiding the horizontal movable unit 5, respectively.

The spray nozzle 4 has a driving structure including a third spline shaft 26 mounted on the horizontal movable unit 5. Rotation of the third spline shaft 26 is transmitted to a nozzle holder 29 through a FRP insulated shaft 38, a worm gear mechanism 27 and a support shaft 28, thereby to oscillate the spray nozzle 4.

A motor 30 acting as a third actuator for varying the nozzle direction is mounted above the base unit 7. A vertical second spline shaft 31 rotated by the motor 30 is mounted on the base unit 7 extending through a second gearbox 32 provided in the lift unit 6.

Figure 6:
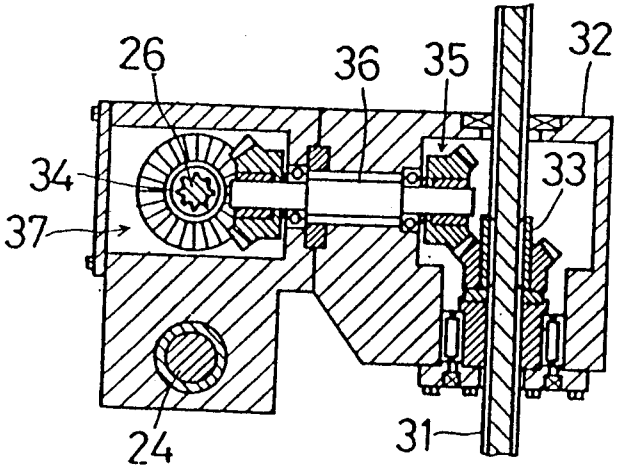
FIGS. 5 and 6 are enlarged front view of the machine.

As shown in FIG. 6, a second ball spline 33 is mounted on the second gearbox 32 for slidably fitting on the second spline shaft 31 to receive rotation of the second spline shaft 31. Also, a third ball spline 34 is mounted on the second gearbox 32 for relatively slidably fitting on the third spline shaft 26 to transmit drive to the third spline shaft 26. Thus, rotation of the second ball spline 33 is transmitted to the third ball spline 34 through a third bevel gear mechanism 35, a relay shaft 36 and a fourth bevel gear mechanism 37.

More particularly, sliding movement of the second ball spline 33 relative to the second spline shaft 31 permits vertical movement of the lift unit 6, and sliding movement of the third ball spline 34 relative to the third spline shaft 26 permits movement of the horizontal movable unit 5. Thus, a transmission mechanism for transmitting drive of the nozzle direction varying motor 30 mounted on the base unit 7 to the spray nozzle 4 includes the second spline shaft 31, the second ball spline 33, the third bevel gear mechanism 35, the relay shaft 36, the fourth bevel gear mechanism 37, the third ball spline 34, the third spline shaft 26, the insulated shaft 38, the worm gear mechanism 27, the support shaft 28 and the nozzle holder 29. The nozzle direction varying motor 30 mounted on the base unit 7 rotates the third spline shaft 26 on the horizontal movable unit 5, thereby to oscillate the spray nozzle 4 to change its direction.

Numeral 39 denotes a FRP cylindrical insulated support for supporting an extreme end portion of the horizontal movable unit 5. The insulated support 39 in combination with the insulated shaft 38 electrically insulates the spray nozzle 4 having a high voltage portion for electrostatic spray painting from the side automatic painting device 3.

A moving structure of the base unit 7 in the conveying direction of the automobile body, i.e. a moving structure of the side automatic painting device 3 per se will be set forth next. The side wall of the painting booth 1 is provided with rails 40*a* and 40*b* in an upper portion and a lower portion thereof and extending in the conveying direction of the automobile body, respectively. Above the base unit 7 is provided a first roller 41 rolling on the upper rail 40*a* with a load of the base unit 7, abd a pair of second rollers 42 sandwiching the upper rail 40*a* in a transverse direction of the upper rail 40*a*. A pair of third rollers 43 is mounted in the lower portion of the base unit 7 to sandwich the lower rail 40*b* in the transverse direction of the lower rail 40*b*, thereby to guide the base unit 7 in the conveying direction of the automobile body.

A chain 44 having fixed opposite ends for receiving moving reaction is mounted on the upper portion of the side wall of the painting booth along the upper rail 40*a*. On the base unit 7 are mounted a pair of idling sprockets 45 meshing with the chain 44, a driving sprocket 46 meshing with an inner surface of a U-shaped chain portion resulting from winding around the idling sprockets 45, and a base unit driving motor 47 for rotating the driving sprocket 46, respectively. Rotation of the driving sprocket 46 by the motor 47 allows the base unit 7 to move in the conveying direction of the automobile body to vary the position of the side automatic painting device 3.

Numeral 48 denotes a box for defining an operator's booth integrally formed with the side wall of the painting booth 1. This box 48 is divided into an upper chamber 48*a*, an operator's booth 48*b*, and a lower chamber 48*c* by partitions 49 and 50. The upper chamber 48*a* houses an accommodating unit 51 together with the upper rail 40*a* and the reaction receiving chain 44 to give an allowance to a painting hose, a pneumatic hose, an electric cable and the like extending to the side automatic painting device 3 for varying the position of the side automatic painting device 3. The lower chamber 48*c* houses control panels including an electric control panel, a pneumatic control panel and the like.

A viewer window 52 is provided in a portion of the side wall of the painting booth 1 corresponding to the operator's booth 48*b*.

The lift unit driving motor 10, the horizontal movable unit driving motor 16 and the nozzle direction varying motor 30 are unitedly controlled by a controller (not shown) based on a predetermined program with circumstances including a kind of the automobile body A, a conveying speed of the automobile body A, a spray painting mode with respect to the side surface of the automobile body A and the like. When these circumstances varies, the program is modified to change the moving speed and a vertical reciprocating width of the lift unit 6, and the moving mode of the horizontal movable unit 5 and the oscillating mode of the spray nozzle 4 along with the vertical movement of the lift unit 6, as a result of which a suitable spray painting operation can be effected in response to any conditions.

(i) Other embodiments will be listed below.

The first movable portion (corresponding to the horizontal movable unit 5 in the foregoing enbodiment) movable in the direction toward and away from the work object A and the second movable portion (corresponding to the list unit 6 in the foregoing embodiment) movable in the specified direction perpendicular to the moving direction of the first movable unit 5 may be structurally modified in various ways.

(ii) In supporting the spray nozzle 4 by the supporting portion (corresponding to the base unit 7 in the foregoing embodiment) through the serially arranged first and second movable portions 5 and 6, the first movable portion 5 is positioned closer to the spray nozzle 4 and the second movable portion 6 is positioned closer to the supporting portion 7 in the supporting order in the foregoing embodiment. Alternatively, the second movable portion 6 may be positioned closer to the spray nozzle 4, and the first movable portion 5 may be positioned closer to the supporting portion 7.

(iii) The moving direction of the first movable portion 5, i.e. the direction toward and away from the work object A, is not limited to the horizontal direction. Likewise, the moving direction of the second movable portion 6, i.e. the specified direction perpendicular to the moving direction of the first movable portion 5, is not limited to the vertical direction.

(iv) While one of the first and second movable portions 5 and 6 which is positioned closer to the supporting portion 7 in the supporting order is allowed to move, the transmission mechanism for transmitting drive of the actuator mounted on the supporting portion 7 (corresponding to the motor in the foregoing embodiment) to the movable portion positioned closer to the spray nozzle 4 in the supporting order may be modified in various ways.

(v) While the first and second movable portions 5 and 6 are allowed to move, respectively, the transmission mechanism for varying the nozzle direction for transmitting drive of the third actuator mounted on the supporting portion 7 (corresponding to the motor 30 in the foregoing embodiment) to the spray nozzle 4 may be modified in various ways.

(iv) In addition, the third actuator 30 may be mounted on either one of the first movable portion 5 or the second movable portion 6. Also, the direction varying movement by oscillation of the spray nozzle 4 may be omitted.

(vii) The first actuator 16 for the first movable portion 5, the second actuator 10 for the second movable portion 6, and the third actuator 30 for varying the nozzle direction are not limited to the motors, but may be drive cylinders.

(viii) The work object A is not limited to the automobile body, but may be any objects including a casing for domestic electric products, a railroad vehicle and the like.

(ix) A fixed type supporting portion may be used instead of the movable supporting portion 7.

What is claimed is:

1. An automatic spray painting machine comprising:

a first movable portion movable in a direction toward and away from a work object, a second movable portion movable in a specified direction perpendicular to the moving direction of the first movable portion, a supporting portion for supporting a spray nozzle, a first actuator for moving the first movable portion, and a second actuator for moving the second movable portion, wherein the first and second actuators are mounted on the supporting portion, wherein a transmission mechanism for transmitting drive of the actuator to the movable portion positioned closer to the spray nozzle in the supporting order effects drive transmission, with the other movable portion positioned closer to the supporting portion in the supporting order being allowed to move, and wherein the transmission mechanism comprises a first spline shaft rotated by said second actuator, a first ball spline slidably fitted on said first spline shaft for receiving rotation of this first spline shaft, a first gear means for transmitting rotation of said first ball spline.

2. An automatic spray painting machine comprising:

a first movable portion movable in a direction toward and away from a work object, a sesond movable portion movable in a specified direction perpendicular to the moving direction of the first movable portion, a supporting portion for supporting a spray nozzle, a first actuator for moving the first movable portion, and a second actuator for moving the second movable portion, wherein the first and second actuators are mounted on the supporting portion, and wherein a transmission mechanism for transmitting drive of the actuator to the movable portion positioned closer to the spray nozzle in the supporting order effects drive transmission, with the other movable portion positioned closer to the supporting portion in the supporting order being allowed to move, wherein the transmission mechanism comprises, a first spline shaft rotated by the second actuator, a first ball spine slidably fitted on the first spline shaft for receiving rotation of the first spline shaft, a first bevel gear mechanism, a relay shaft and a second bevel gear mechanism for transmitting rotation of the first ball spline, a screw shaft receiving rotation of the first ball spline through the first bevel gear mechanism, the relay shaft and the second bevel gear mechanism, and a ball screwed portion fitted on the screw shaft for transmitting rotation of the screw shaft to the first movable portion.

3. An automatic spray painting machine as claimed in claim 1 wherein the spray nozzle is directionally variable by oscillation in the moving direction of the second movable portion, the supporting portion carries a third actuator for oscillating the spray nozzle, and wherein a transmission mechanism for varying the nozzle direction and transmitting drive of the third actuator to the spray nozzle effects drive transmission, with the first and second movable portions being allowed to move.

4. An automatic spray painting machine comprising:

a first movable portion movable in a direction toward and away from a work object, a seond movable portion movable in a specified direction perpendicular to the moving direction of the first movable portion, a supporting portion for supporting a spray nozzle, a first actuator for moving the first movable portion, and a second actuator for moving the second movable portion, wherein the first and second actuators are mounted on the supporting portion, and wherein a transmission mechanism for transmitting drive of the actuator to the movable portion positioned closer to the spray nozzle in the supporting order effects drive transmission, with the other movable portion positioned closer to the supporting portion in the supporting order being allowed to move, wherein the spray nozzle is directionally variable by oscillation in the moving direction of the second movable portion, the supporting portion carries a third actuator for oscillating the spray nozzle, and wherein a transmission mechanism for varying the nozzle direction and transmitting drive of the third actuator to the spray nozzle effects drive transmission, with the first and second movable portions being allowed to move, and wherein the transmission mechanism comprises, a second spline shaft rotated by the third actuator, a second ball spline slidably fitted on the second spline shaft for receiving rotation of the spline shaft, a third bevel gear mechanism, a relay shaft and a fourth bevel gear mechanism for transmitting rotation of the second ball spline, a third ball spline for receiving rotation of the second ball spline through the third bevel gear mechanism, the relay shaft and the fourth bevel gear mechanism, a third spline shaft fitted on the third ball spline thereby to receive rotation, an insulated shaft, a worm gear mechanism and a support shaft for transmitting drive of the third spline shaft to the spray nozzle, and a nozzle holder for oscillating the spray nozzle through the insulated shaft, the worm gear mechanism and the support shaft.

5. An automatic spray painting machine as claimed in claim 1 wherein said first gear means comprises a first bevel gear mechanism, a relay shaft and a second bevel gear mechanism.

6. An automatic spray painting machine as claimed in claim 1 wherein the spray nozzle is directionally variable by oscillation in the moving direction of the second movable portion, the supporting portion carries a third actuator for oscillating the spray nozzle, and wherein a transmission mechanism for varying the nozzle direction and transmitting drive of the third actuator to the spray nozzle effects drive transmission, with the first and second movable portions being allowed to move, and wherein said transmission mechanism further comprises, a second spline shaft rotated by the third actuator, a second ball spline slidably fitted on the second spline shaft for receiving rotation of the spline shaft, and a third gear means for transmitting rotation of said second ball spline.

7. An automatic spray painting machine as claimed in claim 6 wherein said third gear means comprises a third bevel gear mechanism, a relay shaft and a fourth bevel gear mechanism.

* * * * *